United States Patent [19]

Berstein et al.

[11] Patent Number: 4,747,285

[45] Date of Patent: May 31, 1988

[54] SURFACE-HARDENING OR SMOOTHING ROLLING MACHINE

[75] Inventors: Garri Berstein; Willi Hansen, both of Erkelenz; Rudolf Winkens, Erkelenz-Gerderath, all of Fed. Rep. of Germany

[73] Assignee: W. Hegenscheidt GmbH, Erkelenz, Fed. Rep. of Germany

[21] Appl. No.: 902,153

[22] Filed: Aug. 29, 1986

[30] Foreign Application Priority Data

Aug. 30, 1985 [EP] European Pat. Off. ..... 85110947.0
Jan. 14, 1986 [EP] European Pat. Off. ..... 86100403.4

[51] Int. Cl.[4] ..... B21K 1/08
[52] U.S. Cl. ..... 72/110
[58] Field of Search ..... 29/6; 72/81, 110, 111

[56] References Cited

U.S. PATENT DOCUMENTS 4,559,798 12/1985 Hayashi et al. ..... 72/110

FOREIGN PATENT DOCUMENTS 67074 4/1985 Japan ..... 29/6

*Primary Examiner*—Lowell A. Larson
*Attorney, Agent, or Firm*—Herbert L. Lerner; Laurence A. Greenberg

[57] ABSTRACT

Surface-hardening and smoothing rolling machine for rolling at least eccentrically disposed surfaces on a workpiece, having equipment for seating and rotatably driving the workpiece, and comprising at least one movable rolling device at least including a die carrier with at least one rolling element and a die carrier with at least one backing element, the movable rolling device being movable together with the workpiece, and being arranged in a position which is linearly changeable in a radial plane of the workpiece.

33 Claims, 4 Drawing Sheets

SURFACE-HARDENING OR SMOOTHING ROLLING MACHINE

The invention relates to a rolling machine for surface-hardening and smoothing, respectively, for rolling at least eccentrically arranged surfaces on a workpiece, with means for receiving or seating and rotatably driving the workpiece and with at least one movable rolling device having a die carrier with at least one rolling element and a die carrier with at least one backing element, each movable rolling device being moved by and with the workpiece.

Machines of the aforedescribed type have become known heretofore e.g. from German Published Non-Prosecuted Application (DE-OS) No. 33 33 603. Adaptation of the spatial disposition of the rolling device, for example, to crankshafts having different strokes, in this reference, is associated with great mechanical expense and also connected with high costs from the control aspect because of the necessity for computing angular positions of the elaborate mechanical system. Moreover, a weight-neutral position with respect to the pivot arm supporting the surface hardening rolling devices is possible only for a quite specific type of crankshaft. In any other crankshaft type, additional mass forces are applied in an undesired manner by the pivot arm to the crankshaft to be rolled. Furthermore, due to the restricted pivotablity of the pivot arm carrying the rolling devices, the adaptation to different strokes is also very limited. Therefore, it is an object of the invention to provide a rolling machine of the type described in the introduction hereto which succeeds by simple means in ensuring within wide limits the adaptation thereof to different workpieces with at least different eccentricities, such as on crankshafts having different strokes, and to different angular positions of the surfaces to be machined. If necessary, this adaptation should also be achievable automatically.

With the foregoing and other objects in view, there is provided, in accordance with the invention a surface-hardening and smoothing rolling machine for rolling at least eccentrically disposed surfaces on a workpiece, having equipment for seating and rotatably driving the workpiece, and comprising at least one movable rolling device at least including a die carrier with at least one rolling element and a die carrier with at least one backing element, the movable rolling device being movable together with the workpiece, and being arranged in a position which is linearly changeable in a radial plane of the workpiece. This linear changeability of position is readily manageable in size and direction thereof and readily performable from the point of view of equipment or hardware. It is almost unlimited in size and permits by the simplest means the approach or arrival of any point in a radial plane.

In accordance with another feature of the invention, the position of the movable rolling device is linearly changeable in two independent coordinate directions in the radial plane associated therewith. These coordinate directions preferably form the axes of a cartesian system of coordinates. Each point of the radial plane is thereby easily determinable and approachable.

In accordance with a further feature of the invention, at least one movable rolling device is arranged so as to be movable in a coordinate direction perpendicular to the radial plane. In this manner, by the simplest means, adaptation of the machines to changing spacings of the surfaces to be machined in axial direction is additionally successfully achieved. The adaptability of the machine to different workpieces is thereby enlarged or expanded.

In accordance with an added feature of the invention, at least another rolling device arranged so that its position is changeable in a radial plane of a workpiece, e.g. a crankshaft in a coordinate system wherein adjustment of the position of the rolling dies to journal diameter of a workpiece region to be machined is possible. By a simple linear motion, it is thereby possible to take into account additionally different diameters of the workpiece surfaces to be machined, due to which the adaptability of the machine to different workpieces is further improved.

In accordance with an additional feature of the invention, the two coordinate directions wherein changes in position are effected are horizontal and vertical. This simplifies the construction of the machine.

In accordance with yet another feature of the invention, the movable rolling device is suspended from a pivot arm so as to pivot about a first pivot pin parallel to the workpiece, the pivot arm, in turn, being suspended in the machine so as to pivot about a second pivot pin parallel to the first pivot pin, and being lockable in at least one pivoted position. This is a relatively simple construction for achieving the desired mobility by the simplest means.

In accordance with yet a further feature of the invention, the second pivot pin is arranged so as to be changeable in position in a radial plane of the workpiece. The mobility is thus expanded in a relatively simple manner.

In accordance with yet an added feature of the invention, the second pivot pin is arranged in a support device which is, in turn, carried by a crossbar braced against a standard of the machine and connected to adjusting drives affording an adjustment of the position of the second pivot pin at least in a plane transverse to e.g. a crankshaft axes with at least a horizontal and vertical component. Due to this relatively simple measure, the second pivot pin can be moved by the support device at least in a plane transversely to the workpiece axis, e.g. the crankshaft axis, so that practically an adaptation to any stroke differences and stroke lengths and a positioning in any angular position and in relatively simple manner becomes possible. At the same time, this makes it possible to move one or more complete devices out of working range entirely so that an adaptation to a changing number of surfaces areas to be machined also becomes possible in this manner.

In accordance with yet an additional feature of the invention, the support device comprises a slide driveable transversely to the crankshaft axes e.g. and disposed in a slide carrier with a slide guideway, and including an adjusting drive effective between the slide and the slide carrier. This is a particularly simple construction of a support device in slide form, the production, assembly and monitoring of the function of such slides being relatively simple and requiring no complicated devices. Nor is highly skilled personnel or special knowhow necessary for maintenance so that operating readiness is assured. Very simple and reliably mastered mechanics in all operations permits the desired adaptability.

In accordance with yet an added feature of the invention, the slide carrier is guided on the crossbar so as to be movable vertically in vertical guideways and is connected to another adjusting drive carried by the crossbar. These very simple means increase the automatic adjustability and, hence, the adaptability of the machine to different workpiece conditions. All motion cycles and the monitoring thereof remain easily observable.

In accordance with still another feature of the invention, two fluid cylinders operatively act upon the pivot arm in opposite directions for pivoting the pivot arm into a given position and maintaining it there so as to lock the pivot arm in the given position. The desired locking action is thus affected in an elegant and simple manner. Unobservable mass accelerations when positioning and subsequently locking the pivot arm and corresponding, disagreeable reactions upon the entire machine are thereby avoided.

In accordance with still a further feature of the invention, one of the two fluid cylinders has a first end position defining a first pivoted position and a second end position defining a second pivoted position of the pivot arm, the other of the fluid cylinders being operative with less force than the one fluid cylinder at least for locking in the first pivoted position. This certainly is the simplest imaginable possibility for arriving at and locking in two desired positions.

In accordance with still an added feature of the invention, a lever pivotally mounted on the pivot arm and actuatable by a fluid cylinder is likewise disposed on the pivot arm, the lever having a free end pressable against the rolling device associated therewith in order to bring the rolling device into a given pivoted position. With these relatively simple means it is possible to avoid any necessity for balancing the rolling device e.g. by means of springs, and the rolling device is kept by simple means, yet reliably, in the correct pivoted position for a new setup or positioning. It is important, however, that the center of gravity of the surface-hardening rolling device be located in front of the pivot axis of the surface-hardening rolling device on the pivot arm so that a definite or unequivocal direction of movement or pivoting direction of the surface-hardening rolling device is determined.

In accordance with a supplementary feature of the invention, the crossbar is mounted on the machine standard so as to be changeable in position. An adaptation of the position of all of the rolling devices in axial direction is additionally possible in this manner upon demand.

In accordance with still an additional feature of the invention, at least an additional one of the elements consisting of a rolling element and a backing element is carried by at least one die carrier, at least one rolling element being changeable into at least two positions of which at least one position is a working position.

Due to the fact that the respective rolling device is movable and connected to only one power actuating device, care is taken that the rolling force acts upon the workpiece only as a transverse force and is mutually cancelled out there. Additional transverse forces which could stress the workpiece and which stem from the power actuating device are avoided to a great extent. The presence of at least one additional rolling element and/or backing element having a position which is changeable in the manner described makes a die change unnecessary or superfluous for appropriate workpieces so that time is gained thereby in the production of larger lots. At the same time, greater flexibility of the machine is obtained thereby, because the machine according to the invention can react, within certain limits, to the workpiece construction through an appropriate change in position of the rolling elements and/or the backing elements. In the medium lot range, it is also imaginable to employ fewer rolling devices in a single apparatus and to feed them to the respective workpiece location to be rolled, thereby making a selection by appropriately repositioning the backing elements and/or the rolling elements so that a suitable die is applied to the respective workpiece site. Such a machine can also react to different workpieces so that it is unnecessary to provide a machine for each specific workpiece, nor is it necessary any longer to provide a rolling device for each workpiece location to be rolled.

In accordance with another feature of the invention, at least one of the elements consisting of the rolling element and the backing element is arranged so as to be changeable in position on the respective carrier. Due to the fact that at least one rolling element and/or backing element is disposed on the die carrier so as to be changeable in position, the construction of the machine can be simplified, at least for certain applications and, at the same time, the insertion of a workpiece into the machine can be facilitated through this changeability of position. The position changeability succeeds not only in bringing different elements to the working site when needed or desired, but also success is achieved in removing corresponding elements from the working site and returning them to the working site after a workpiece has been inserted.

In accordance with a further feature of the invention, the rolling element and the backing element, respectively, is an element of a roller head. Roller heads with rolling elements are already known and have proven out well. The use of such roller heads in a machine of the type according to the invention increases the efficiency of such a machine further in that the spare parts inventory can be reduced and restricted essentially to the roller heads. In addition, the use of such roller heads ensures a simpler construction of the machine.

In accordance with other features of the invention, an independent roller head is provided for each rolling element or rolling element pair and/or for each backing element or backing element pair. This ensures the standardization of the roller head construction so that identical roller heads can always be used even in machines having different number of rolling elements so that the different number of rolling elements is obtained simply by varying the roller heads.

In accordance with an added feature of the invention, each of the roller heads is so disposed on a die carrier associated therewith as to be changeable in the position thereof. This provides a relatively simple way of bringing the respective roller head into a desired position.

In accordance with an additional feature of the invention there is provided a die holder provided on at least one of the die carriers, the die holder being changeable from one to another pre-determinable position, with at least one element of the rolling element and the backing element being movable into the positions by means of the die holder, at least one of the elements in working position being connectible kinematically to the power actuating device. A die holder which is changeable in position and equipped with appropriate rolling elements and backing elements, respectively, is relatively easy to realize structurally. Success is thereby achieved in supporting and guiding rolling elements and backing elements at the same time.

In accordance with yet another feature of the invention, the die holder is constructed as a roller head for the element. The idea behind the invention is thus able to be realized even when space conditions are cramped. At the same time, the overall construction is simplified thereby.

In accordance with an alternate feature of the invention, the die holder carries at least one roller head. This makes it possible, on the one hand, to equip the machine differently when adapting it to certain production conditions and, on the other hand, success is achieved, at least in part, by using roller heads which are already available.

In accordance with yet a further feature of the invention, there are provided at least two roller heads disposed so as to be changeable into a plurality of positions, at least one of the positions being the working position. With a simple arrangement of this kind, it is possible to handle a multiplicity of different workpiece dimensions.

In accordance with an alternative feature of the invention, the roller heads are disposed on a guideway for changing the position thereof. This is a simple and space-saving construction for executing a change in position. Together with the roller heads, the rolling elements and/or the backing elements are then changed in position thereof at the same time.

In accordance with yet an added feature of the invention, there is provided actuating means for performing the change in position of the roller heads. Actuating devices or actuators engineered specifically for executing a change in position and constructed and disposed accordingly are simple to realize and facilitate the execution of the change in position.

In accordance with yet an additional feature of the invention, the die holder has at least one position more than the number of roller heads carried thereby. Even in the event of a multiple arrangement of roller heads, this succeeds in attaining a position in which none of the roller heads present is in working position. This facilitates the complete exchange of the dies and, in particular, the replacement of broken surface-hardening rollers and, under certain circumstances, the work involving the insertion of the workpiece can be facilitated also.

In accordance with another aspect of the invention, there is provided a rolling machine with a driving mechanism for a workpiece to be rolled and with at least one movable rolling device comprising a pair of arms hinged to one another and connected kinematically with a power actuating device for generating a rolling force. Such a construction permits the exertion of great rolling forces on the workpiece when the available space is limited, these rolling forces being cancelled out mutually on the workpiece itself so that an additional, undesired, radial load on the workpiece stemming from the rolling force is avoided. It must be emphasized at this juncture, that joining the arms in scissors fashion does not have to mean that a joint be present somewhat in the center of the arms. It is quite possible to place the joint, for example, also at one end of the arms and thus join the arm ends to one another. The other ends of the arms then carry the dies, and it is then possible to connect a power actuating device kinematically to these arms on one or the other side of the dies for generating the rolling force. Such a construction creates favorable lever ratios for generating the rolling force.

In other words, and this is noted expressly, the scissorslike connection hinging the arms to one another does not necessarily have to be constructed as shown in the drawing, although such a construction may also be especially purposeful. Basically, no scissorslike connection at all has to be provided, of course; rather, it is also possible to guide and move the carriers, for example, parallel to one another and to connect them kinematically to a power actuating device, so that the die carriers can be moved parallel towards one another and away from one another.

In accordance with a concomitant feature of the invention the rolling device has at least one element of a group consisting of rolling and backing elements, respectively arranged in fixed position relative to a die carrier associated therewith. It may be advantageous for certain applications to change rolling elements and/or backing elements or to bring them, respectively, into and out of the working position by repositioning the entire rolling device accordingly. The rolling elements and/or backing elements must then be disposed in fixed position relative to the associated die carrier.

In accordance with another aspect of the invention, the rotary drive of the workpiece is controlled in accordance with the angle of rotation thereof, the angular position of the workpiece and the position of setting of at least one movable rolling device in the radial plane being controllable in mutual dependence. By relatively simple means, the workpiece surface to be machined and a rolling device associated therewith are always able to be brought automatically into the correct position relative to one another.

A machine according to the invention is usually equipped with several rolling devices. The rolling devices may also be of different types. The workpiece is driven centrally via a separate workpiece drive, the angle of rotation of which may be controlled, if necessary or desirable.

It is possible and, depending upon the desired flexibility, sensible, in a machine according to the invention, to construct rolling devices according to the invention which can travel along a workpiece axis so that the rolling devices can be moved into desired and preprogrammed working positions via appropriate driving and controlling means such as programmable NC controls. In this connection, the program may not only effect the positioning of the rolling devices themselves, but also the selection of the dies to be brought into position.

Other features which are considered as characteristic for the invention are set forth in the appended claims.

Although the invention is illustrated and described herein as embodied in a surface-hardening or smoothing rolling machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 5:
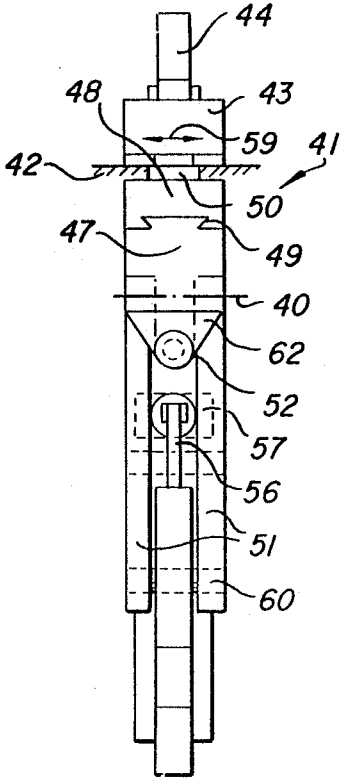
FIG. 5 is a front elevational view of FIG. 4 as seen in the direction of the arrow B.
Figure 4:
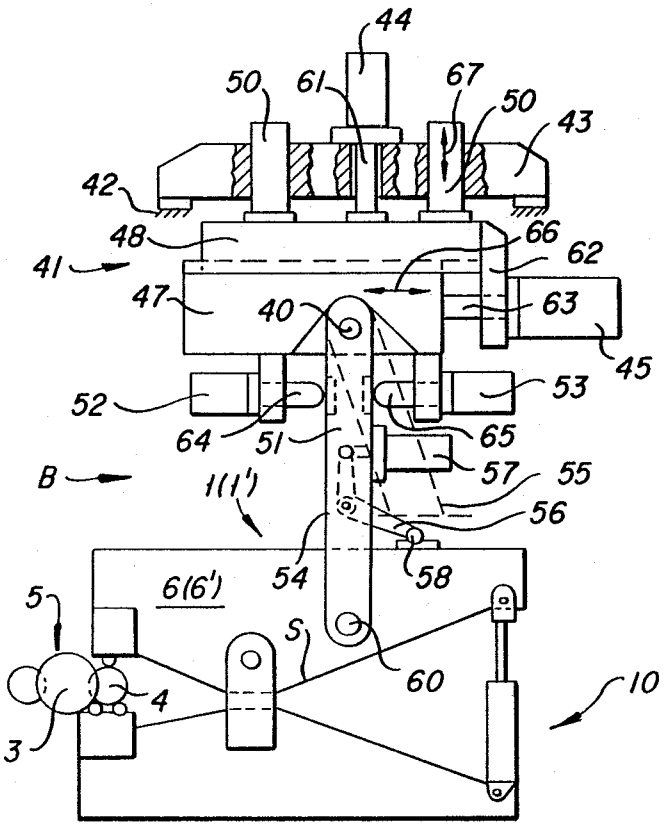
FIG. 4 is a side elevational view of a surface-hardening rolling device with a support device and a crossbar constructed in accordance with the invention.

Referring now to the drawing and first, particularly, to FIGS. 4 and 5, thereof, there is shown a surface-hardening rolling device 1 or 1' pivotally suspended in the plane of the drawing by means of a pivot pin 60 from a pivot arm 51. The pivot arm 51 formed of two parallel legs carries a lever 56 which is also pivotally disposed in the plane of the drawing, and is operatively connected to a fluid or flow medium cylinder 57 likewise fastened to the pivot arm 51. A free end 58 of the lever 56 can be pressed by means of the fluid cylinder 57 against the surface-hardening rolling device 1 and 1', respectively, in the manner apparent from FIG. 4, thereby causing the surface-hardening rolling device to execute a pivoting movement about the pivot pin 60 in the plane of the drawing. With this pivoting motion, the surface-hardening rolling device is to be swung into the position shown in FIG. 4 which is required for a new setup to accommodate another crankshaft type and in order to apply the devices to the bearing locations to be rolled. The surface-hardening rolling devices 1 and 1', respectively, are thereby disposed so that their center of gravity S is located in front of the pivot pin 60 in the manner shown in FIG. 4 so that the dead weight of the respective surface-hardening rolling device will press it against the free end 58 of the lever 56. During the rolling operation, the free end 58 of the lever 56 is swung away so that the freedom of motion of the respective surface-hardening rolling device 1 and 1', respectively, is not interfered with. The pivot arm 51 in turn is suspended from a slide 47 so as to pivot about a pivot about a pivot pin 40 disposed parallel to the pivot pin 60. The slide 47 is guided in a slide carrier 48 so as to be movable transversely to the crankshaft axis 46. Essentially, the slide carrier 48 and the slide 47 form a support device 41 for the pivot arm 51 and for the surface hardening rolling device 1 and 1', respectively, fastened thereto.

The slide carrier 48 has two vertical guiding devices 50 constructed as round guides and movable vertically in a crossbar 43 in the direction of the arrow 67. Attached to the crossbar 43 is the cylinder body of a fluid cylinder having a piston rod 61 which is fastened to the slide carrier 48, the cylinder being constructed as a fluid cylinder and forming an adjusting drive 44. Guided by the vertical guiding means 50, the slide carrier 48 can be moved vertically and positioned by means of this adjusting drive 44. But this may just as well involve an electric motor-powered adjusting drive, the slide carrier 48 then being moved vertically by the electric motor, for example, via a ball screw. The construction of the electric motor may be such that the vertical distance traveled by means of the ball screw be measured exactly. This makes possible in the simplest manner a vertical positioning of the support device 41.

The crossbar 43 supporting the entire support device is supported in turn by the machine standard 42 and may be mounted there so as to be movable in the direction of the arrow 59 and fastenable. In this manner, a side positioning can additionally be permitted.

Together with the vertical motion of the slide carrier 48, the slide 47 disposed so as to be movable in the slide carrier is also moved vertically. The adjusting drive 45 for adjusting or moving the slide 47 may be constructed, for example, as a fluid cylinder, the cylinder body, in turn, bracing itself against and being fastened to an extension arm 62 of the slide carrier 48, while the piston rod 63 is fastened to the slide 47. A retracting or extending movement of the slide 47 effects a corresponding movement of the slide 47 in the direction of arrow 66. Of course, here again, the adjusting drive 45, as described hereinbefore, may be powered electo-motively instead of being a fluid cylinder. The slide guiding device 49 for the slide 47 is constructed as a dovetail guideway in the embodiment. For space-saving reasons it may also be constructed so as to be swung through 90°. The means for guiding the slide 47 in the slide carrier 48 is not, however, restricted to a dovetail guideway.

Provided under and attached to the slide 47 are fluid cylinder 52 and 53, one in front of and one behind the pivot arm 51. The piston rods 64 and 65 of the aforementioned fluid cylinders, respectively acting in opposite directions, can be brought into contact with the pivot arm 51. To move the pivot arm 51 into a first pivoted position 54, the fluid cylinder 53 is operated with a greater force than the other fluid cylinder 52, and the piston rod 65 is extended up to the stop thereof. The pivot arm 51 has then reached its first pivoted position 54. To lock it in this first pivoted position 54, the piston rod 64 of the fluid cylinder 52 is driven against the pivot arm 51, but with less force than the force of the piston rod 65, so that the pivot arm 51 is clamped and thus locked between the piston rod 65 and 64 in its first pivoted position 54. It is in this pivoted position that the surface-hardening rolling devices can be engaged with the bearing locations to be rolled.

The pivot arm 51 can also be moved, however, into a second pivoted position 55, so that the piston rod 65 of the fluid cylinder 53 is retracted completely and the piston rod 64 of the fluid cylinder 52 is extended so far that the pivot arm 51 again comes into contact with the retracted piston rod 65 due to its pivoting motion. The second pivoted position has then been reached. This makes it possible to swing the respective surface-hardening rolling device out of the working range of the machine without having to change the basic setup of the device. If the second pivoted position 55 is still insufficient for this, the lever 56 may also be pivoted so that the free end 58 no longer contacts the surface-hardening rolling device 1 and 1', respectively, and the latter flaps downwardly due to the location of the center of gravity S in the plane of the drawing. This makes it possible to achieve an automatic adaptation to changing numbers of journals while retaining the basic setup of the devices.

When the crankshaft types change, it also frequently occurs that, together with the change in crankshaft type, not only the stroke lengths and the angular positions of the crank journals, but also the fillet radii is to be rolled, the diameters of the bearing locations to be rolled and the bearing widths of the bearing locations to be rolled change either simultaneously or singly. This will then require changing the affected dies, which must be performed manually according to the state of the art. A supplemental development of the machine according to the invention is intended to eliminate this drawback also and ensure an automatic adaptation of the machine to the described further changes of the various dimensions on different crankshafts. To this end, the respective surface-hardening rolling device must be appropriately constructed.

Figure 1:
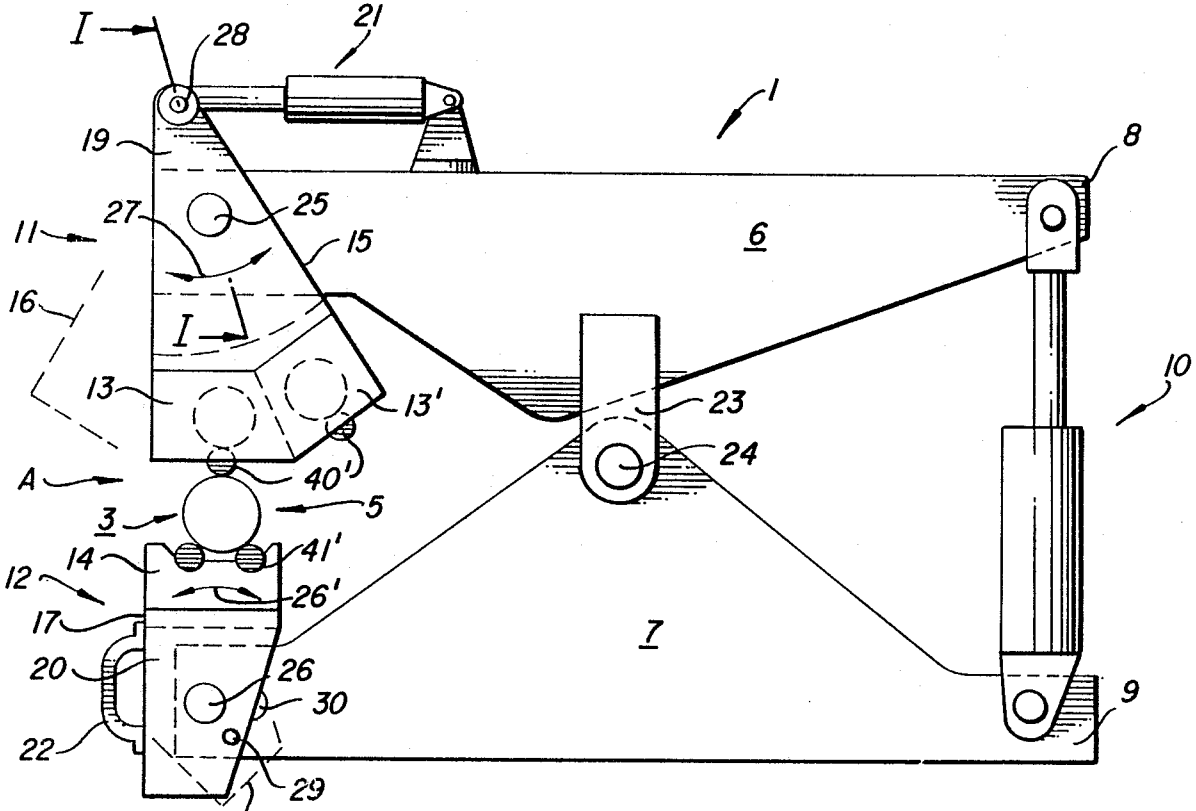
FIG. 1 is a side elevational view of one embodiment of a surface-hardening rolling device according to the invention.
Figure 2:
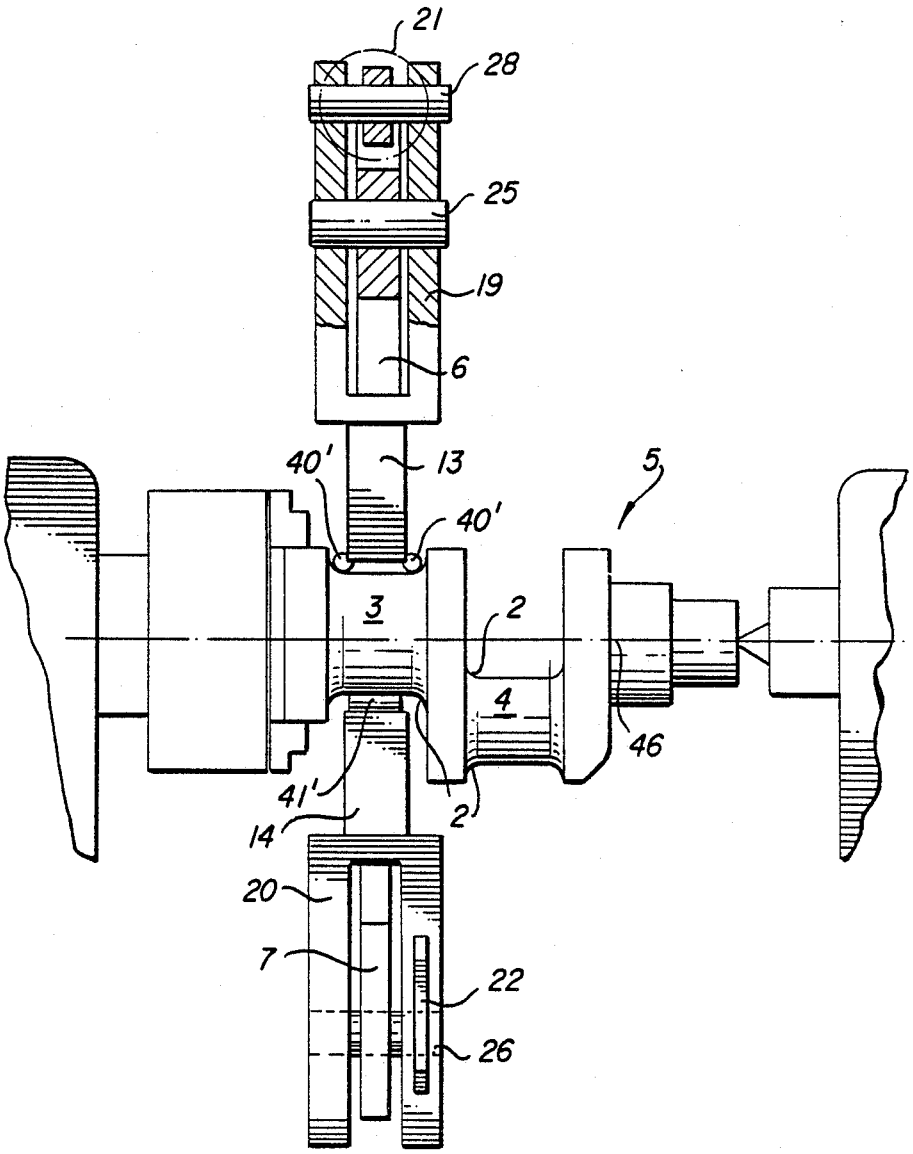
FIG. 2 is an enlarged front elevational view of FIG. 1 as seen in the direction of the arrow A.
Figure 3:
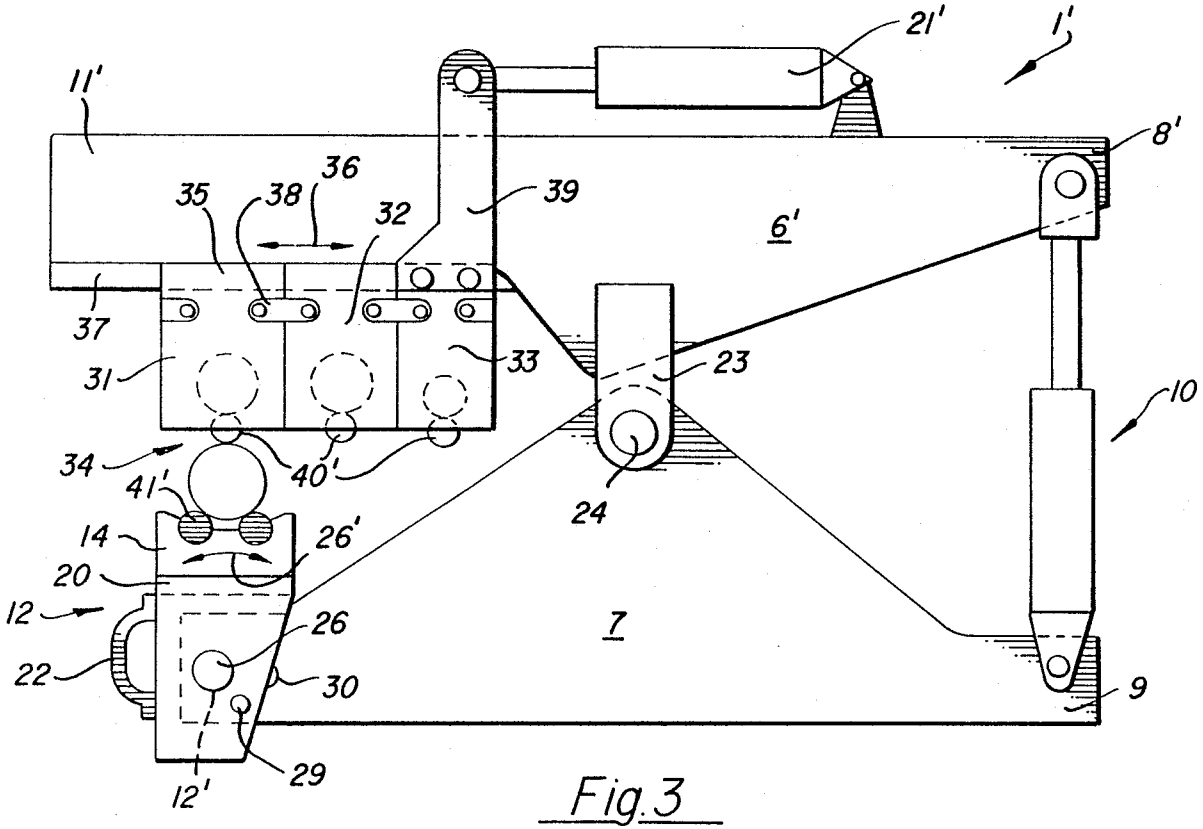
FIG. 3 is a view like that of FIG. 1 of another embodiment of the device.

The construction necessary for such surface-hardening rolling devices is illustrated in FIGS. 1 through 3. The surface-hardening rolling device 1 is formed primarily of two arms 6 and 7. These arms 6 and 7 may be hinged to one another in conventional scissors-like manner via plates or webs 23 and a pivot pin 24. Disposed at mutually opposite rear ends 8 and 9 in a likewise conventional manner is a piston/cylinder unit 10 which moves the arms 6 and 7 in a manner similar to that for a pair of pliers or scissors. According to the present state of the art, a respectively required roller head is disposed at an end 11 of the arm 6 opposite the end 8 thereof and at an end 12 of the arm 7 opposite the end 9 thereof. In the surface hardening rolling device according to the invention, on the other hand, pivot pins 25 and 26, respectively, are provided thereat which articulatingly support forkshaped levers 19 and 20, respectively. The levers 19 and 20 can thus pivot freely about the pivot pins 25 and 26, respectively, as indicated by the arrows 27 and 26'.

A piston rod of a piston/cylinder unit 21 is connected to one end of the lever 19 via an articulating joint 28 while a cylinder of the piston/cylinder unit 21 is braced against the arm 6. In the indexing position shown in FIG. 1, the lever 19 is in an angular position 15. Disposed at the other end of the lever 19 opposite the one end thereof are conventional surface-hardening rolling dies 13 and 13' constructed as double dies in the illustrated embodiment of FIGS. 1 and 2. In the angular position 15 of lever 19, the surface-hardening roller head 13 is in working position.

The backing roller head 14 mounted on the lever 20 is disposed in a conventional manner opposite the surface-hardening roller head 13. The angular position 17 of the lever 20 keeps the backing roller head 14 in working position so that fillet or transition radii 2 can be rolled on the main bearing 3. This requires that the levers 6 and 7 be moved by the piston/cylinder unit 10 in a conventional manner so as to cause the surface-hardening roller head 13 and the backing roller head 14 to contact the respective bearing points of the crankshaft 5. Of course, it is not only the main bearing 3 of the crankshaft 5 which can be surface-hardened in this manner, but also equally as well the connecting rod bearing 4 in the region of the fillets 2 thereof. All that is required is that an appropriate device be additionally provided. The multiple arrangement of such devices, however, has become known heretofore from the hereinafore cited literature pertaining to the state of the art. Therefore, a detailed description of such a multiple arrangement is believed to be unnecessary here. The cited literature pertaining to the state of the art may be referred to in this context. It is also possible, however, to move the apparatus 1 and 1', respectively, axially from machining site to machining site, as indicated by the arrow 42 in FIG. 2.

To machine the crankshaft 5, it may be checked between centers, as shown in FIG. 2 and centrally driven so that the surface-hardening rolling device 1 does not have to be suspended via master components or shafts. As an alternative, however, it is possible as well to mount the crankshaft 5 in the surface-hardening rolling devices 1 without centers and to guide and drive the surface-hardening rolling devices 1 via master shafts.

Machining of the crankshaft can then be performed in a manner already known in the state of the art. If a crankshaft with, for example, different fillet radii should then arrive as the next workpiece, the surface-hardening roller head 13' may be adapted for this task. In order to be able then to surface-harden the crankshaft with the different fillet radii 2, the piston/cylinder unit 21 is actuated so that its piston rod retracts. This causes the lever 19 to move from the angular position 15 to the angular position 16 represented by broken lines. This brings the surface-hardening roller head 13' into working position, and the crankshaft 5 with the different radii can be rolled by means of the rolling elements 40. The pivoting motion of the lever 19 in the direction of the arrow 27, of course, is by no means restricted to the two indexing positions described with respect to the embodiment of FIGS. 1 and 2. More than two indexing positions may be provided. By the same token, more than two surface-hardening roller heads, also with respectively different rolling elements 40, may be used. Depending upon the particular use or application, it is also sensible to provide only a single surface-hardening roller head 13, for example, when the then possible outwardly swinging motion via the lever 19 should only or preferably additionally serve the purpose of simplifying the die change for the die 13 or, in case of fracture or failure of the rolling elements 40, of simplifying the replacement of the rolling elements by improving the accessibility thereof. Such an outwardly swinging motion, however, can also simplify the insertion of the workpiece.

The backing roller head 14 can also be pivoted, for example, by means of a handle 22, in the direction of arrow 28 from the angular position 17, which represents the working position, into the angular position 18. All that is required to accomplish this is the removal of the locking bolt 29 so that the lever 20 can then be pivoted effortlessly by means of the handle 22. The locking bolt 29 is then reinserted in the angular position 18 and is then seated in a hole 30 formed in the arm 7. In this pivoted position, the backing roller head 14 can be exchanged effortlessly. It is also conceivable, however, to construct the lever 20 like the lever 19 so that the lever 20 can carry several different backing roller heads for different bearing shapes.

A surface-hardening rolling device 1' according to FIG. 3 is essentially of a construction quite similar to that of the aforedescribed surface-hardening rolling device of FIGS. 1 and 2. Then arm 7 with the backing roller head 14, which is mounted on the arm 7 via the lever 20 so as to pivot about the pivot pin 26, can be of exactly the same construction as has already been described in connection with FIG. 1. This lever 7 is again hinged to an arm 6' by means of the pivot pin 24 and the plate or web 23, and the rear ends 8' and 9 of the arms 6' and 7, respectively, are connected to a piston/cylinder unit 10 which is to effect the pivoting motion of the arms 6' and 7 relative to one another and which generates the required rolling force.

The construction of the arm 6' of FIG. 3 differs from that of the arm 6 of FIG. 1. In the region of the front end 11' of the arm 6', it has on the underside thereof a slide guideway 37 on which one or more slides 35 may be disposed. The one or more slides 35 are movable in the direction of the double-headed arrow 36. In the embodiment of FIG. 3, the slides 35 carry surface-hardening roller heads 31, 32 and 33 which, in turn, contain rolling elements 40. Because several slides 35 are provided in the embodiment of FIG. 3, the surface-hardening roller heads 31 through 33 are interconnected by brackets or straps 38. The surface-hardening roller head 31 is shown in working position in FIG. 3, while the surface-hardening roller heads 32 and 33 are shown available for a roller-head change.

To execute a shifting motion of the roller heads 31 through 33 on the slide guideway 37, the roller head 33 with its associated slide 35 is connected to the piston/-cylinder unit 21' via an arm 39. A retracting or extending motion of the piston rod of this piston/cylinder unit 21' effects a corresponding motion of the slides 35 and, hence, of the roller heads 31 through 33 in the direction of the arrow 36. Thereby, any desired roller head can be brought into or out of the working position 34. In the respective working position 34, the roller head which is in working position can be locked mechanically or kept therein by a position control of the piston in the piston/-cylinder unit 21'.

It is quite possible with this construction to make the respective slide 35 an integral part of the roller head to be associated therewith. It is also possible to construct several roller heads as one structural unit so that only one roller head is present as a subassembly which, however, has several work stations.

By the same token, it is also possible, of course, to use a roller head arrangement, as described hereinbefore with regard to the lever 6', also in the form of backing roller heads on the arm 7. All that is then necessary is to construct the front end 12' of the arm 7 like the front end 11' of the arm 6'.

The aforedescribed surface-hardening rolling device may be used both in surface-hardening rolling machines according to the state of the art cited at the introduction hereto and also as a separate or individual apparatus.

It is also possible to dispose the rolling element 40 and/or the backing elements 41 in fixed position relative to the associated die carrier and to move the die carrier itself or the entire apparatus in order to effect the change in position, or to change its position in another way. Of course, it is also possible to provide additionally for a die carrier or the entire apparatus to be movable or changeable in position.

The foregoing is a description corresponding, in substance, to European application No. 85 110 947.8, dated Aug. 30, 1985, International priority of which is being claimed for the instant application, and which is hereby made part of this application. Any material discrepancies between the foregoing specification and the specification of the aforementioned corresponding German application are to be resolved in favor of the latter.

We claim:

1. Surface-hardening and smoothing rolling machine for rolling at least eccentrically disposed surfaces on a workpiece, having equipment for seating and rotatably driving the workpiece, and comprising at least one movable rolling device at least including a die carrier with at least one rolling element and a die carrier with at least one backing element, said movable rolling device being movable together with the workpiece, and being arranged in a position which is linearly changeable in a radial plane of the workpiece.

2. Rolling machine according to claim 1 wherein said position of said movable rolling device is linearly changeable in two independent coordinate directions in the radial plane associated therewith.

3. Rolling machine according to claim 2 wherein said two coordinate directions wherein changes in position are effected are horizontal and vertical.

4. Rolling machine according to claim 1, wherein said movable rolling device is suspended from a pivot arm so as to pivot about a first pivot pin parallel to the workpiece, said pivot arm, in turn, being suspended in the machine so as to pivot about a second pivot pin parallel to said first pivot pin, and being lockable in at least one pivoted position.

5. Rolling machine according to claim 4 wherein said second pivot pin is arranged so as to be changeable in position in a radial plane of the workpiece.

6. Rolling machine according to claim 4, wherein said second pivot pin is arranged in a support device which is, in turn, carried by a crossbar braced against a standard of the machine and connected to adjusting drives affording an adjustment of the position of said second pivot pin at least in a plane transverse to a workpiece axis with at least a horizontal and vertical component.

7. Rolling machine according to claim 6, wherein said support device comprises a slide drivable transversely to the workpiece axis and disposed in a slide carrier with a slide guideway, and including an adjusting drive effective between said slide and said slide carrier.

8. Rolling machine according to claim 7, wherein said slide carrier is guided on said crossbar so as to be movable vertically in vertical guideways and is connected to another adjusting drive carried by said crossbar.

9. Rolling machine according to claim 8, including two fluid cylinders operatively acting upon said pivot arm in opposite directions for pivoting said pivot arm into a given position and maintaining it there so as to lock said pivot arm in said given position.

10. Rolling machine according to claim 9 wherein one of said two fluid cylinders has a first end position defining a first pivoted position and a second end position defining a second pivoted position of said pivot arm, said other of said fluid cylinders being operative with less force than said one fluid cylinder at least for locking in said first pivoted position.

11. Rolling machine according to claim 10, including a lever pivotally mounted on said pivot arm and actuatable by a fluid cylinder likewise disposed on said pivot arm, said lever having a free end pressable against the rolling device associated therewith in order to bring said rolling device into a given pivoted position.

12. Rolling machine according to claim 1, wherein said at least one movable rolling device is arranged so as to be movable in a coordinate direction perpendicular to said radial plane.

13. Rolling machine according to claim 1, including at least another rolling device arranged so that its position is changeable in a radial plane of a workpiece in a coordinate system wherein adjustment of the position of the rolling dies to journal diameter of a workpiece region to be machined is possible.

14. Rolling machine according to claim 1, wherein said crossbar is mounted on said machine standard so as to be changeable in position.

15. Rolling machine according to claim 1, wherein at least an additional one of the elements consisting of a rolling element and a backing element is carried by at least one die carrier, at least one rolling element being changeable into at least two positions of which at least one position is a working position.

16. Machine according to claim 1 wherein at least one of the elements consisting of said rolling element and said backing element is arranged so as to be changeable in position on the respective carrier.

17. Machine according to claim 1 wherein said rolling element and said backing element, respectively, is an element of a roller head.

18. Machine according to claim 17 including a respective independent roller head for each of said rolling elements.

19. Machine according to claim 17, including a respective independent roller head for each of said backing elements.

20. Machine according to claim 17 wherein said additional element is a rolling element forming with said one rolling element a respective rolling element pair, and including a respective independent roller head for said rolling element pair.

21. Machine according to claim 17 wherein said additional element is a backing element forming with said one backing element a respective backing element pair, and including a respective independent roller head for said backing element pair.

22. Machine according to claim 17 wherein each of said roller heads is so disposed on a die carrier associated therewith as to be changeable in the position thereof.

23. Machine according to claim 1 including a die holder provided on at least one of said die carriers, said die holder being changeable from one to another predeterminable position, with at least one element of said rolling element and said backing element being movable into said positions by means of said die holder, at least one of said elements in working position being connectible kinematically to said power actuating device.

24. Machine according to claim 23, wherein said die holder is constructed as a roller head for said element.

25. Machine according to claim 24 wherein said die holder has at least one position more than the number of roller heads carried thereby.

26. Machine according to claim 23 wherein said die holder carries at least one roller head.

27. Machine according to claim 1, including at least two roller heads disposed so as to be changeable into a plurality of positions, at least one of said positions being said working position.

28. Machine according to claim 27 wherein said roller heads are disposed on a guideway for changing the position thereof.

29. Machine according to claim 27, including actuating means for performing the change in position of said roller heads.

30. Machine according to claim 29 wherein said actuating means is a fluid-actuated piston/cylinder unit.

31. Rolling machine according to claim 1 with a driving mechanism for a workpiece to be rolled and with at least one movable rolling device comprising a pair of arms hinged scissorslike to one another and connected kinematically with a power actuating device for generating a rolling force.

32. Rolling machine according to claim 31 wherein said rolling device has at least one element of a group consisting of rolling and backing elements, respectively arranged in fixed position relative to a die carrier associated therewith.

33. Rolling machine according to claim 1 wherein the rotary drive of the workpiece is controlled in accordance with the angle of rotation thereof, the angular position of the workpiece and the position of setting of at least one movable rolling device in the radial plane being controllable in mutual dependence.

* * * * *